US005121463A

United States Patent [19]

Yoshihara

[11] Patent Number: 5,121,463

[45] Date of Patent: Jun. 9, 1992

[54] HOT AIR PULSE GENERATOR FOR BLOWING OUT HEATED AIR IN A PULSE-LIKE MANNER

[75] Inventor: Kenjiro Yoshihara, Tokyo, Japan

[73] Assignee: Yoshihara & Co., Ltd., Tokyo, Japan

[21] Appl. No.: 504,673

[22] Filed: Apr. 3, 1990

[30] Foreign Application Priority Data

Apr. 7, 1989 [JP] Japan ..... 1-41584[U]

[51] Int. Cl.[5] ..... A45D 20/00; F24H 3/04; B05B 1/08

[52] U.S. Cl. ..... 392/379; 34/97; 34/243 R; 239/101; 239/222.17; 239/222.21; 239/382; 239/463; 392/368

[58] Field of Search ..... 392/360, 379, 382–385, 392/380, 381, 361–369; 239/101, 102.1, 222.21, 222.17, 382, 383, 463; 34/96–101, 243 R

[56] References Cited

U.S. PATENT DOCUMENTS

| | | | |
|---|---|---|---|
| 1,093,006 | 4/1914 | Nelson | 239/101 X |
| 1,751,754 | 3/1930 | Overshiner | 392/360 |
| 4,019,260 | 4/1977 | Levy et al. | 34/97 X |
| 4,097,722 | 6/1978 | Soler et al. | 34/243 R X |
| 4,132,360 | 1/1979 | Lee | 239/383 |
| 4,210,162 | 7/1980 | Dreyer et al. . | |
| 4,295,283 | 10/1981 | Tomaro | 34/97 |

FOREIGN PATENT DOCUMENTS

| | | | |
|---|---|---|---|
| 2708117 | 8/1978 | Fed. Rep. of Germany . | |
| 2509150 | 1/1983 | France | 392/385 |
| 452809 | 5/1968 | Switzerland . | |
| 2123688 | 2/1984 | United Kingdom | 392/385 |

*Primary Examiner*—Anthony Bartis

*Attorney, Agent, or Firm*—Fay, Sharpe, Beall, Fagan, Minnich & McKee

[57] ABSTRACT

A hot air pulse generator, particularly for use as a hair dryer, includes a housing enclosing an electric heater and air blower for generating a continuous flow of heated air through a passageway leading to a nozzle. A gently curved baffle arranged across the passageway upstream of the nozzle cuts off 50–75% of the cross section of the passageway and converges the heated air as a high speed air stream toward one side of the passageway. A butterfly valve freely rotatable through 360° on a spindle disposed at an acute angle is located between the baffle and nozzle in the path of the air stream and is continuously rotated by the air flow to effect an intermittent pulsed air output flow through the nozzle.

13 Claims, 1 Drawing Sheet

HOT AIR PULSE GENERATOR FOR BLOWING OUT HEATED AIR IN A PULSE-LIKE MANNER

BACKGROUND OF THE INVENTION

The present invention relates to a hot air pulse generator. More particularly, the invention relates to a hot air pulse generator, utilizing a hot air generating apparatus such as a hair drier, in particular, or the like, or an apparatus which combines an air blower with a heat source of a far infrared radiation heat treatment apparatus and the like.

Conventionally, hot air generating apparatuses, such as, for example a hair drier, blow out a uniform continuous flow of hot air of a fixed quantity and air pressure, from a nozzle. Such a hair drier is so constructed as to achieve only its inherent functions: blow-drying, setting hair, etc. The apparatus with the heat source of the far infrared radiation heat treatment apparatus is also so constructed as to achieve only its inherent functions.

SUMMARY OF THE INVENTION

It is an object of the present invention to provide a hot air pulse generator, which, in addition to its inherent functions, massages the head or other parts of the body needing to be massaged by means of hot air blown out in a pulse-like manner, the hot air being obtained from the hot air generating apparatus or the apparatus which combines the air blower with the heat source of the far infrared radiation heat treatment apparatus.

The hot air pulse generator comprises a hot air generating means including a heater and an air blower contained within a housing having a nozzle on a side opposite to the hot air generating means. The housing defines a passageway leading to the hot air generating means, with a baffle arranged across the passageway of the housing for converging hot air, as a air stream, toward one side of the passageway, where a butterfly valve is rotated by the air stream generated by the baffle.

Hot air, as a high-speed air stream caused by the baffle, strikes against a butterfly valve and is stopped from blowing out of a nozzle when the butterfly valve is closed. The hot air provides the butterfly valve with a turning force. When the butterfly valve is rotated by the turning force, a nozzle opens, allowing the hot air to blow out of the nozzle. When the butterfly valve is rotated again, the valve is closed again, thus stopping the hot air from being blown out. By repeating the steps described above, the hot air blows out, not in a uniform flow with a fixed quantity and air pressure, but in an intermittent pulse-like flow, which is alternately strong and weak. This pulse-like flow imparts a massaging sensation to the object of the air flow.

DETAILED DESCRIPTION OF THE PREFERRED EMBODIMENTS

An embodiment of the present invention will now be described with reference to the accompanying drawings. In this invention, the embodiment is applied to a hair drier as a hot air pulse generator.

Figure 1:
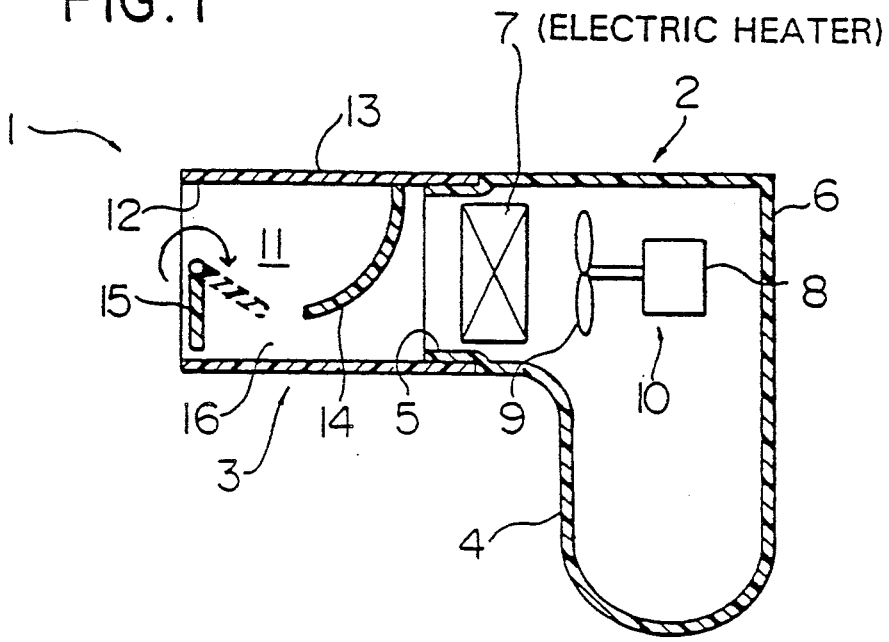
FIG. 1 is a section view showing a hot air pulse generator, of a hair drier, of an embodiment according to the present invention.

As shown in FIG. 1, the hot air pulse generator 1 of a hair drier comprises a hot air generating portion 2 and a pulse generating portion 3. The hot air generating portion 2 includes a housing 6, which has a handle 4 and a primary nozzle 5, just like an ordinary hair drier. Within the housing 6 are arranged an electric heater 7, and an air blower 10, including an electric motor 8 and a fan 9. The electric heater 7 is a Nichrome wire heater of a generally known type. The pulse generating portion 3 is attached to the primary nozzle 5 of the housing 6 and defines a passageway 11, which extends to the primary nozzle 5. A cylindrical housing 13, having a secondary nozzle 12, is so arranged as to oppose the hot air generating portion 2. A baffle 14 is disposed across a passageway 11 of the cylindrical housing 13. Hot air flowing through the passageway 11 converges as a high-speed air stream toward one side of the passageway 11 under the influence of a damper 14. A butterfly valve 15, preferably a single-wing butterfly valve, is provided at the secondary nozzle 12 of the cylindrical housing 13. The butterfly valve 15 is rotated by means of the hot air stream generated by the baffle 14.

In order to converge the hot air flowing through the passageway 11 toward one side of the passageway 11, the baffle 14 should not be arranged perpendicularly to the passageway 11 so as to stop the flow of the hot air, but rather, as shown in FIG. 1, the baffle 14 is preferably formed in a gentle curve which curves toward a baffle opening 16 so as to guide the hot air smoothly toward one side of the passageway 11. Further, as shown in FIG. 2, the baffle 14 is desirably so constructed that the cut-off area formed by the baffle 14 covers more than half the area of the cross-sectional passageway 11, leaving less than half the cross-sectional area for air to pass.

Figure 2:
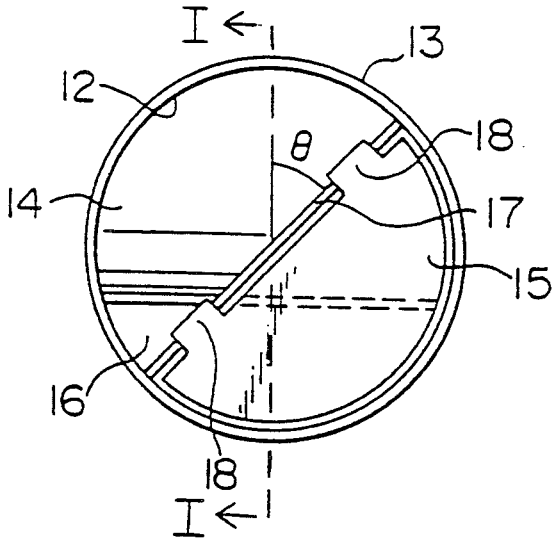
FIG. 2 is a front view illustrating the hot air pulse generator.

As shown in FIG. 2, the butterfly valve 15 is arranged across the secondary blowout hole 12, and has fixing projections 18 for coupling with apertures formed in spindle 17 fixed to the cylindrical housing 13 by screws or the like (not shown) as is known. The butterfly valve 15 is thus rotatably attached to the spindle 17 at the fixing portions 18. The shape of the butterfly valve 15 is semicircular, having a slightly smaller diameter than the inside diameter of the cylindrical housing 13. The spindle 17 should not be attached so as to be parallel to the vertical direction in FIG. 2, but the spindle 17 is desirably attached at an inclination angle of $\theta$ relative to the vertical direction. The butterfly valve 15 is thus correspondingly attached at the angle of $\theta$.

The housing 6, the cylindrical housing 13, the baffle 14 and the butterfly valve 15 may be molded from a highly heat-resistant material, such as polycarbonate. The baffle 14 may be molded as an integral part of the cylindrical housing 13, or recessed into the housing, by using another material.

In this embodiment as constructed above, the hot air, generated by the air blower 10 and the electric heater 7, flows out of the primary nozzle 5, and converges toward one side of the passageway 11 because of the baffle 14. Thus, the hot air flows out of the baffle opening 16; air stream strikes against the butterfly valve 15, and is stopped from blowing out of the nozzle 12, when the valve is closed, as shown in FIG. 2. At the same time, the hot air provides the butterfly valve 15 with a turning force. When the butterfly valve is rotated by the turning force, the nozzle opens, thus allowing the hot air to flow out of the blowout hole 12 smoothly. When the butterfly valve 15 is rotated again, the valve is closed again, thus stopping the hot air from being blown out. By repeating the steps described above, the hot air blows out, not in a uniform flow with a fixed quantity and wind pressure, but in an intermittent pulse-like flow, which is alternately strong and weak.

In this embodiment, the conditions under which the hot air pulse is generated depend upon the ratio of the cut-off area of the baffle 14 to the opening area of the passageway 11 and upon an attaching angle $\theta$ of the spindle 17 in relation to the opened direction of the baffle opening 16.

That is, if the ratio of the area cut-off by the baffle 14 decreases, the effect of the hot air pulse decreases due to a slowed flow velocity caused by less converged air stream, and to the fact that the single-wing butterfly valve is provided with less turning force. On the contrary, if the ratio increases, the butterfly valve is provided with a strong turning force, the single-wing butterfly valve is rotated too fast, thus generating almost a continuous flow of the hot air. As a result, the hair drier operation is less comfortable.

Further, if the attaching angle $\theta$ of the spindle 17 in relation to the opened direction of the baffle opening 16 approaches an angle of 0°, the hot air flow area drift, strikes against, increases when the single-wing butterfly valve is closed again by another 180° rotation after the valve is closed as shown in FIG. 2. When the valve is thus closed, the single-wing butterfly valve is rotated slowly, because a collision of the hot air against the baffle functions as a force which weakens the turning force. Thus, the effect of the hot air pulse decreases. On the contrary, if the attaching angle $\theta$ of the spindle 17 in relation to the opened direction of the baffle opening 16 approaches an angle of 90°, an opposite phenomenon to the above occurs, i.e., the single-wing butterfly valve is rotated too fast, thereby the hot air generates almost a continuous flow.

According to a test result, the optimum pulse-like hot air was obtained under the following conditions: the ratio of the area cut-off by the baffle 14 to the area of opening of the passageway 11 was 50–75%, and the attaching angle $\theta$ of the spindle 17 in relation to the opened direction of the baffle opening 16 was approximately an angle of 45°.

According to the present invention, while using a hair drier, the pulse-like blown hot air massages the head and improves the circulation of the blood around the hair roots.

In this embodiment, although the single-wing butterfly valve 15 is used, a double-wing butterfly valve is also acceptable.

Moreover, the butterfly valve may have a bowl-like, rather than plate-like, shape. A butterfly valve with a weight attached may also be used to obtain, when required, more stable rotation of the valve. In the case of the butterfly with a weight, the desirable attaching angle of the spindle 17 is likely different from the above-mentioned angle.

Furthermore, in this embodiment, although the housing 6 and the cylindrical housing 13 are composed as separate portions, they may be composed together as an integral part.

An embodiment of the present invention has been described with particular reference to a hot air pulse generator of a hair drier. The present invention hitherto described is not limited to the above-described hot air pulse generator, but may also be applied to other apparatuses with heat sources, such as a far infrared radiation heat treatment apparatus.

It is possible according to the present invention to provide a product, which, in addition to the inherent functions of a hot air pulse generator of a hair drier, or an apparatus with a heat source of a far infrared radiation heat treatment apparatus, massages the head or other parts of the body needing to be massaged.

The invention has been described in detail with particular reference to the preferred embodiment thereof, but it will be understood that variations and modifications of the invention can be effected within the spirit and scope of the invention.

What is claimed is:

1. A hot air pulse generator comprising:

hot air generating means including a heater and an air blower for generating a substantially continuous flow of heated air;

a housing having a nozzle downstream from said hot air generating means, said housing defining a passageway leading from said hot air generating means to said nozzle;

a baffle arranged across said passageway of said housing between said hot air generating means and said nozzle for converging the heated air, as a high-speed air stream, toward one side of said passageway as the air flows toward said nozzle;

a freely rotatable butterfly valve located within said passageway and arranged to be continuously rotated through 360° by said heated air stream exiting from said baffle to effect an intermittent pulsed air output flow, wherein said butterfly valve is sized and positioned so as to substantially completely obstruct the high-speed air stream in a first position, and allows increasing flow of the air stream followed by decreasing flow of the air stream as it is rotated through 360° back to its first position on each revolution of the valve by the air stream when rotated from said first position; and a spindle fixed across said nozzle of said housing, said spindle being attached at a predetermined acute angle in relation to a line which runs through the center of said passageway and the center of said nozzle, said butterfly valve being rotatably attached to the spindle;

wherein said baffle is formed as a gentle curve which curves toward said nozzle of said housing, and wherein said baffle defines a cross-sectional area cut-off from the passageway, the cut-off area covering at least half the cross-sectional opening of the passageway defined by said housing.

2. A hot air pulse generator according to claim 1, wherein said butterfly valve is a single-wing butterfly valve.

3. A hot air pulse generator according to claim 2, wherein said single-wing butterfly valve is semicircular, and has a slightly smaller diameter than the inside diameter of said housing.

4. A hot air pulse generator according to claim 1, wherein the cut-off area covers substantially 50 to 75% of said cross-sectional opening.

5. A hot air pulse generator according to claim 1, wherein said predetermined angle is substantially 45°.

6. A hot air pulse generator according to claim 1, further comprising handle means attached to said housing for supporting said hot air pulse generator by hand.

7. A hot air pulse generator according to claim 1, wherein the passageway defined by said housing is substantially cylindrical.

8. A hot air pulse generator according to claim 1, wherein the baffle and the butterfly valve extend substantially perpendicularly to the direction of air flow through the passageway at least in part to effect an air flow restriction in said passageway.

9. A hot air pulse generator according to claim 8, wherein said predetermined angle is substantially 45°.

10. A hot air pulse generator according to claim 8, wherein the passageway defined by said housing is substantially cylindrical, and further comprising handle means attached to said housing for supporting said hot air blast generator by hand, said handle means extending generally perpendicularly from the cylindrical passageway.

11. A hot air pulse generator according to claim 10, wherein said line is generally parallel to the extension of said handle.

12. A hot air pulse generator according to claim 11, wherein the cut-off area covers substantially 50 to 75% of said cross-sectional opening.

13. A hot air pulse generator according to claim 1, wherein the housing, baffle and butterfly valve are all constructed from a polycarbonate material.

* * * * *